United States Patent [19]

Mizoguchi et al.

[11] Patent Number: 4,922,876

[45] Date of Patent: May 8, 1990

[54] FUEL INJECTION DEVICE

[75] Inventors: Kenji Mizoguchi; Hitoshi Takeuchi; Yoshiyasu Nishigaki; Yoshihiro Kato; Shinichi Sakakibara, all of Obu, Japan

[73] Assignee: Aisan Kogyo Kabushiki Kaisha, Obu, Japan

[21] Appl. No.: 328,508

[22] Filed: Mar. 24, 1989

[30] Foreign Application Priority Data

Mar. 25, 1988 [JP] Japan ..... 63-40024[U]
Jul. 18, 1988 [JP] Japan ..... 63-94676[U]

[51] Int. Cl.[5] ..... F02M 39/00
[52] U.S. Cl. ..... 123/470; 123/590
[58] Field of Search ..... 123/470, 471, 472, 590, 123/337, 557

[56] References Cited

U.S. PATENT DOCUMENTS

| | | | |
|---|---|---|---|
| 3,393,984 | 7/1968 | Wisman | 123/590 |
| 4,300,506 | 11/1981 | Knapp | 123/337 |
| 4,333,441 | 6/1982 | Still | 123/590 |
| 4,513,720 | 4/1985 | Takeda | 123/470 |
| 4,519,371 | 5/1985 | Nagase | 123/470 |
| 4,572,128 | 2/1986 | Okamoto | 123/470 |
| 4,727,843 | 3/1982 | Peterson | 123/470 |
| 4,757,789 | 7/1988 | Laiwe | 123/470 |

FOREIGN PATENT DOCUMENTS

| | | | |
|---|---|---|---|
| 0052673 | 3/1982 | Japan | 123/470 |
| 0129256 | 8/1982 | Japan | 123/470 |
| 0148267 | 9/1983 | Japan | 123/470 |
| 0204958 | 11/1983 | Japan | 123/470 |

*Primary Examiner*—Carl Stuart Miller
*Attorney, Agent, or Firm*—Dennison, Meserole, Pollack & Scheiner

[57] ABSTRACT

A throttle body adapted to be mounted between an intake pipe and an intake manifold, the throttle body comprising an upstream body connected to the intake pipe and formed with a substantially horizontal suction passage; a downstream body connected to the intake manifold and formed with a downwardly inclined throttle bore, the throttle bore continuously extending from the suction passage on a downstream side thereof; a throttle valve rotatably mounted in the throttle bore of the downstream body; and a fuel injector mounted to the upstream body in such a manner as to inject fuel toward the throttle valve; wherein the fuel injected from the fuel injector collides with the throttle valve to be atomized and distributed in the downstream body, and is supplied to the intake manifold.

5 Claims, 6 Drawing Sheets

FUEL INJECTION DEVICE

BACKGROUND OF THE INVENTION

The present invention relates to a fuel injection device for a single point injection type, and more particularly to an improved throttle body having a substantially horizontal suction passage therein and adapted to be horizontally connected to an intake manifold.

FIG. 11 shows a conventional throttle body of the above-mentioned type. Referring to FIG. 11, reference numeral 120 designates a throttle body constructed of an upstream body 122 having a suction passage 124 and a downstream body 126 having a throttle bore 128. The upstream body 122 is provided with a fuel injector 140 for injecting fuel into the throttle bore 128. A throttle valve 150 is fixed to a throttle shaft 152 rotatably mounted in the throttle bore 128.

The fuel injector 140 is so positioned as to inject fuel toward the throttle shaft 152 of the throttle valve 150, so that the fuel may be atomized in the throttle bore 128, and is distributed through the intake manifold into cylinders of an engine.

When the throttle valve 150 is rotated from its full closed position at a certain angle $\theta_1$ as shown in FIG. 11, the fuel injected from the fuel injector 140 and colliding with the throttle shaft 152 is widely scattered downwardly onto an inner wall surface 128*a* of the throttle bore 128. As a portion of the throttle bore 128 upstream of the throttle valve 150 is under a substantially atmospheric pressure, and the throttle bore 128 is substantially horizontal, the fuel falling on the inner wall surface 128*a* of the throttle bore 128 is apt to stay on the inner wall surface 128*a* of the throttle bore 128, causing fluctuation of an air-fuel ratio when the opening angle of the throttle valve 150 is small at low- speed running or at idling, for example. Further, when the throttle valve 150 is opened from the small throttle angle position, the fuel staying in the throttle bore 128 tends to be sucked momentarily into the intake manifold to cause overrichness of the air-fuel ratio. As a result, the air-fuel ratio is widely fluctuated to adversely affect exhaust emission.

SUMMARY OF THE INVENTION

It is a first object of the present invention to provide a throttle body which may prevent fuel from staying especially when an opening angle of the throttle valve is small, and thereby prevent an air-fuel ratio from being fluctuated.

It is a second object of the present invention to provide a throttle body which may prevent fuel in a throttle bore from being momentarily sucked into an intake manifold when the throttle valve is opened from a small throttle angle position, and thereby prevent an air-fuel ratio from becoming overrich.

It is a third object of the present invention to provide a throttle body which may prevent supply of fuel from being delayed during low-speed running.

It is a fourth object of the present invention to provide a throttle body which may improve atomization of fuel to thereby improve startability and accelerability of an engine and reduce an adverse affect to exhaust emission.

According to one aspect of the present invention, there is provided a throttle body adapted to be mounted between an intake pipe and an intake manifold, said throttle body comprising an upstream body connected to said intake pipe and formed with a substantially horizontal suction passage; a downstream body connected to said intake manifold and formed with a downwardly inclined throttle bore, said throttle bore continuously extending from said suction passage on a downstream side thereof; a throttle valve rotatably mounted in said throttle bore of said downstream body; and a fuel injector mounted to said upstream body in such a manner as to inject fuel toward said throttle valve; wherein said fuel injected from said fuel injector collides with said throttle valve to be atomized and distributed in said downstream body, and is supplied to said intake manifold.

With this arrangement, when the fuel is injected from the fuel injector to collide with the throttle valve and is scattered to fall onto the inner wall surface of the throttle bore, the fuel is allowed to smoothly flow downstream along the downwardly inclined wall surface of the throttle bore, thereby preventing the fuel from staying in the throttle bore and preventing fluctuation of an air-fuel ratio during low-speed running and at idling. Further, it is possible to prevent the fuel in the throttle bore from being momentarily sucked into the intake manifold when the throttle valve is opened from the small throttle angle position.

Moreover, as the throttle bore is inclined downwardly from the substantially horizontal suction passage in the upstream body, scattering of the fuel after collision with the throttle valve at a small throttle angle may be suppressed to thereby prevent supply of the fuel from being delayed during low-speed running or the like.

According to another aspect of the present invention, there is provided in the above-mentioned throttle body said fuel injector is so mounted as to inject said fuel toward a lower portion of a valve surface of said throttle valve when an opening angle of said throttle valve is small. Alternatively, there is also provided in the above-mentioned throttle body said fuel injector is so mounted as to inject said fuel toward an inner wall surface of said throttle bore substantially under said throttle valve when an opening angle of said throttle valve is large.

With this arrangement, the scattering of the fuel after collision with the valve surface of the throttle valve at a small throttle angle may be suppressed more than the case that the fuel is injected toward the throttle shaft of the throttle valve. Accordingly, the fuel is efficiently supplied by a suction air flowing in the throttle body, thereby preventing an air-fuel ratio from being fluctuated.

When the throttle angle is large, the fuel injected from the fuel injector collides with the inner wall surface of the throttle bore. Accordingly, the fuel is sufficiently supplied directly along the inner wall surface of the throttle bore by a high-speed suction air flowing in the throttle body, thereby preventing an air-fuel ratio from becoming overrich.

According to a further aspect of the present invention, the above-mentioned throttle body further includes a hot water passage formed in a wall of said downstream body at a position substantially under said throttle valve and just upstream of said throttle valve. Alternatively, the above-mentioned throttle body further includes a projection formed on the inner wall surface of said throttle bore at a position substantially under said throttle valve.

With this arrangement, the fuel injected from the fuel injector and falling on the inner wall surface of the throttle bore is warmed by a hot water in the hot water passage, or the fuel injected from the fuel injector collides with the projection. Accordingly, the atomization of the fuel may be further improved to thereby ensure efficient supply of the fuel to the intake manifold.

The invention will be more fully understood from the following detailed description and appended claims when taken with the drawings.

DETAILED DESCRIPTION OF THE PREFERRED EMBODIMENTS

Figure 1:
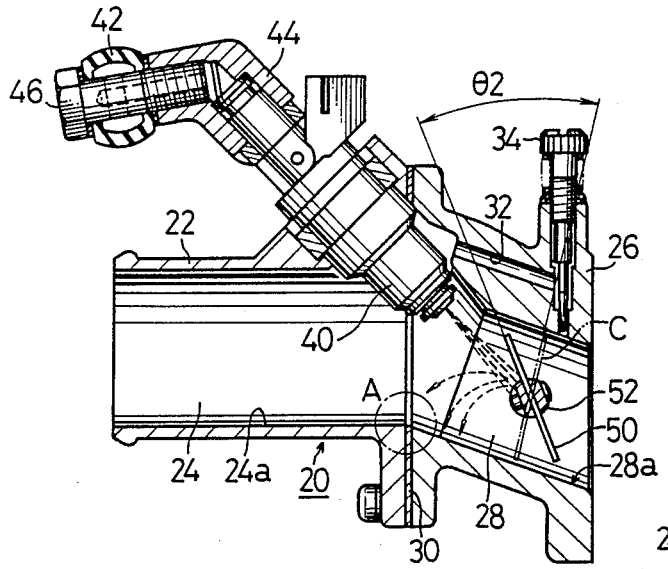
FIG. 1 is a vertical sectional view of the throttle body according to a first preferred embodiment of the present invention at a small throttle angle.

Referring to FIG. 1 which shows an engine suction system including a single point injection type fuel injection device according to the present invention, reference numeral 20 designates a throttle body substantially horizontally provided between a suction pipe 200 connected to an air cleaner 14 and an intake manifold 12 connected to an engine 10. The throttle body 20 is provided with a fuel injector 40 for injecting fuel into the throttle body 20. The fuel injected from the fuel injector 40 is mixed with air induced from the air cleaner 14 through the suction pipe 200 into the throttle body 20, and is supplied through the intake manifold 12 into cylinders of the engine 10.

Referring to FIG. 1 which shows the throttle body 20, the throttle body 20 is constructed of an upstream body 22 connected to the suction pipe 200 and having a substantially horizontal suction passage 24 therein and a downstream body 26 connected to the intake manifold 12 and having a downwardly inclined throttle bore 28 therein. The downstream body 26 is fixed through a gasket 30 to the upstream body 22 by bolts or the like.

The downstream body 26 is provided with a throttle valve 50 fixed to a throttle shaft 52 rotatable in a counterclockwise direction as viewed in FIG. 1 within a predetermined angle range. That is, the throttle valve 50 is rotated between a full closed position shown by a phantom line C and a full open position to be obtained by depressing an accelerator pedal (not shown) and accordingly rotating the throttle shaft 52 in the counterclockwise direction as shown.

The fuel injector 40 is mounted to the upstream body 22 of the throttle body 20, and an upper end of the injector 40 located outside the throttle body 20 is connected through a connecting pipe 44 and a connecting plug 46 to a fuel supply tube 42. A nozzle of the injector 40 is so oriented as to inject the fuel toward the throttle shaft 52 of the throttle valve 50. The mounting position of the injector 40 to the upstream body 22 is so set as to establish compact structure of the suction system and not to increase flow resistance of the suction air flowing in the suction passage 24 of the upstream body 22.

The downstream body 26 is formed in its wall with an idling control air passage 32 provided with an adjusting screw 34 for adjusting an air flow in the idling control air passage 32. The idling control air passage 32 is formed at an optimum position where entry of the fuel injected from the injector 40 into the passage 34 may be avoided. That is, an inlet of the idling control air passage 32 is opened near a side peripheral portion of the injector 40, and an outlet of the idling control air passage 32 is opened at a position just downstream of the throttle valve 50 in the full closed position.

Under a mounted condition of the throttle body 20 to the intake manifold 12, the suction passage 24 of the upstream body 22 is substantially horizontal, while an inner wall surface **28*a* of the throttle bore 28 of the downstream body 26 is inclined downwardly from an inner wall surface 24*a* of the suction passage 24. Further, the downstream body 26 itself is also inclined downwardly from the upstream body 22, and the idling control air passage 32 is also inclined at an angle substantially the same as the angle of inclination of the inner wall surface 28*a* of the throttle bore 28**.

Figure 2:
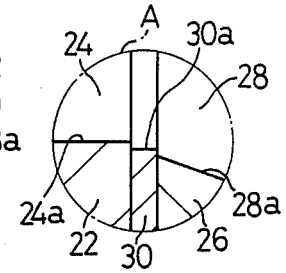
FIG. 2 is an enlarged view of an essential part of the throttle body shown in FIG. 1.
Figure 3:
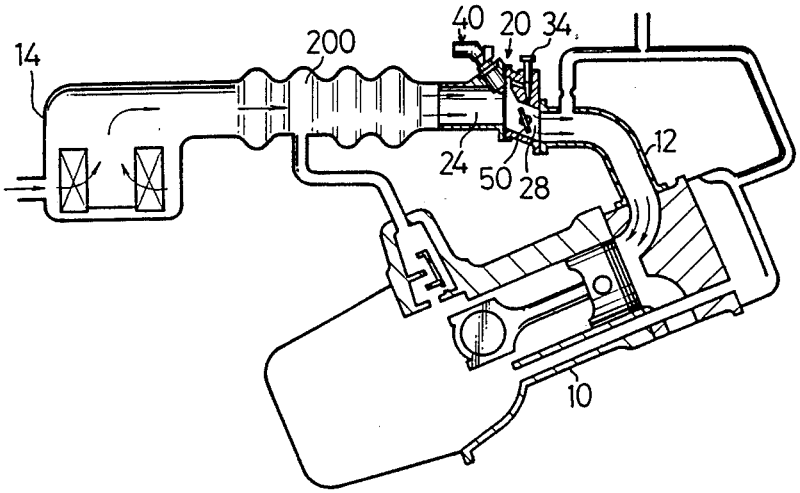
FIG. 3 is a schematic illustration of a suction system including the throttle body shown in FIG. 1.

Referring to FIG. 2 which shows an enlarged view of a portion encircled by a phantom line A as shown in FIG. 1, a lower surface **30*a* of an inner periphery of the gasket 30 is lower than the inner wall surface 24*a* of the suction passage 24 in the upstream body 22, and the inner wall surface 28*a* of the throttle bore 28 in the downstream body 26 is lower than the lower surface 30*a* of the gasket 30**.

In operation, the fuel injected from the injector 40 is directed to the throttle shaft 52 of the throttle valve 50, and collides with the throttle shaft 52. As a result, the fuel is atomized, and is mixed with the suction air induced from the suction passage 24 of the upstream body 22 of the throttle body 20. Then, the fuel mixture is sucked through the intake manifold 12 into the cylinders of the engine 10.

When the throttle valve 50 is rotated from the full closed position to an open position at a given throttle angle $\theta_2$, the fuel injected from the injector 40 and colliding with the throttle shaft 52 is scattered downwardly in a relatively wide area. The scattered fuel is partially deposited on the inner wall surface 28a of the throttle bore 28 and the inner surface 30a of the gasket 30, or there is a possibility that the scattered fuel will partially enter the inlet of the idling control air passage 32.

However, as the inner wall surface 28a of the throttle bore 28 is downwardly inclined, the fuel deposited on the inner wall surface 28a is allowed to smoothly flow down toward the intake manifold 12 and be sucked into the cylinders of the engine 10. Further, as the idling control air passage 32 is also downwardly inclined, the fuel entering the inlet of the idling control air passage is allowed to smoothly flow down toward the outlet of the idling control air passage 32 and be discharged into the throttle bore 28.

Figure 11:
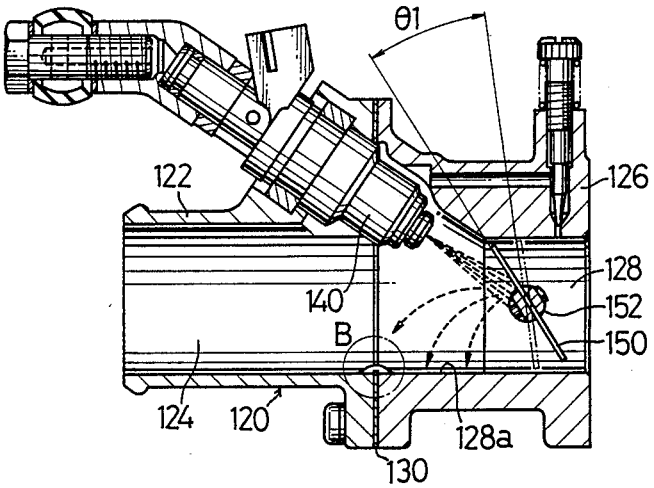
FIG. 11 PRIOR ART
FIG. 11 is a vertical sectional view of the throttle body in the prior art.
Figure 12:
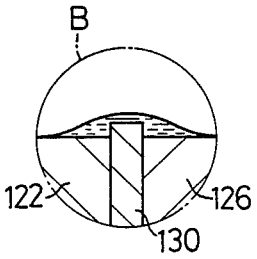
FIG. 12 PRIOR ART
FIG. 12 is an enlarged view of an essential part of the throttle body shown in FIG. 11.
Figure 13:
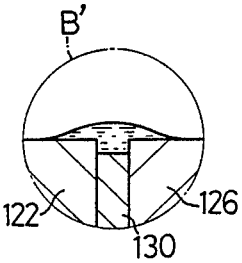
FIG. 13 PRIOR ART
FIG. 13 is an enlarged view similar to FIG. 12, illustrating another example of installation of a gasket.

Referring to FIG. 11 which shows a prior art throttle body 120, a lower portion of the inner peripheral surface of a gasket 130 interposed between elements 122 and 126 of the throttle body 120 is higher than the inner wall surfaces of a suction passage 124 and a throttle bore 128 as apparent from FIG. 12 showing an enlarged view of a portion encircled by a phantom line B in FIG. 11. Alternatively, as shown in FIG. 13, the lower portion of the inner peripheral surface of the gasket 130 is lower than the inner wall surfaces of the suction passage 124 and the throttle bore 128. In such cases, the fuel injected from an injector 140 and colliding with a throttle shaft 152 of a throttle valve 150 tends to stay at the portion of the gasket 130 as shown in FIGS. 12 and 13.

To the contrary, according to the present invention, the lower portions of the inner wall surfaces of the suction passage 24, the gasket 30 and the throttle bore 28 are stepwise lowered in this order. Therefore, there is no possibility that the fuel injected from the injector 40 and colliding with the throttle shaft 52 will stay at the portion of the gasket 30, thus ensuring smooth flow of the fuel toward the intake manifold 12.

Furthermore, the throttle angle $\theta_2$ of the throttle valve 50 wherein the fuel injected and colliding with the throttle shaft 52 is scattered downwardly in a relatively wide area as shown in FIG. 1 is larger than a throttle angle $\theta_1$ as shown in FIG. 11 corresponding to the throttle angle $\theta_2$. In other words, according to the present invention, such wide scattering of the fuel occurs at the throttle angle larger than that in the prior art, and the scattered fuel is conveyed by a high-speed suction air flow at the large throttle angle. Accordingly, at a small throttle angle, such wide scattering of the fuel does not occur to thereby prevent supply of the fuel to the engine from being delayed during low-speed running or at idling.

Moreover, as compared with the prior art device shown in FIG. 11, a distance between the nozzle of the injector 40 and the throttle shaft 52 of the throttle valve 50 is made longer. Accordingly, even when the fuel colliding with the throttle shaft 52 is widely scattered, it is suppressed from reaching the nozzle of the injector 40 and being deposited thereto. Accordingly, it is possible to avoid that the fuel deposited to the nozzle will fall on the inner wall surface 28a of the throttle bore 28 because of vibration or any other causes.

In the event that the fuel will stay in the throttle bore 28 of the throttle body 20 because of various causes, a concentration of CO (carbon monoxide) in an exhaust gas varies. The inventors measured a maximum value Ph and a minimum value Po of the concentration of CO in the exhaust gas at idling, and investigated a relation between a variation between the maximum value Ph and the minimum value Po and an angle of inclination of the throttle bore 28. The result of investigation is shown in FIG. 4.

Figure 4:
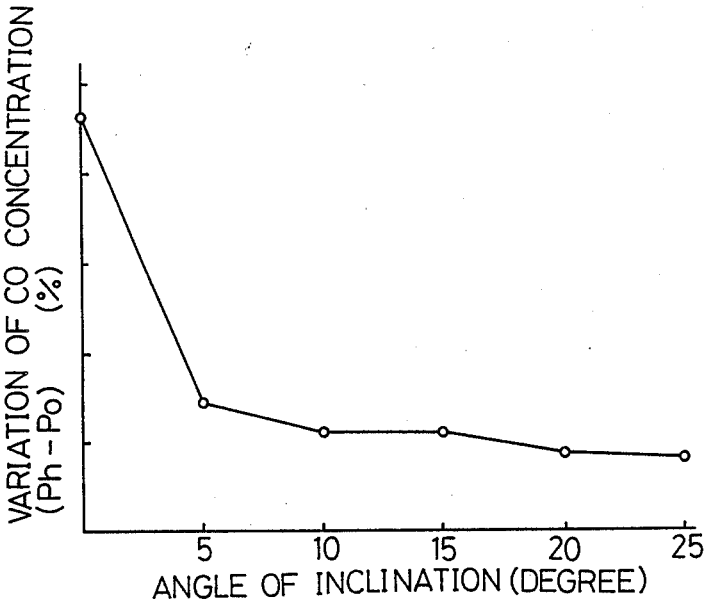
FIG. 4 is a graph showing the relation between an angle of inclination of a throttle bore and a variation in CO concentration.

As is apparent from FIG. 4, when the angle of inclination of the throttle bore 28 is set to a range of 5–25 degrees, the variation of the CO concentration is remarkably reduced. Accordingly, it is appreciated that the angle of inclination of the throttle bore 28 should be selected from the range of 5–25 degrees in consideration of idling stability and horsepower loss.

Figure 5:
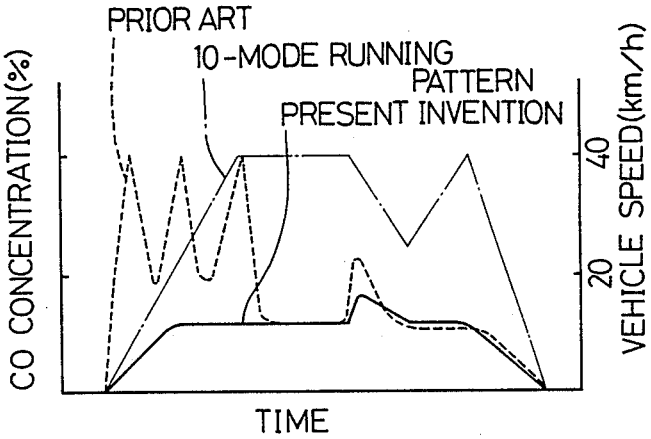
FIG. 5 is a graph showing a change in CO concentration according to the present invention in comparison with the prior art.

Further, the inventors measured a concentration of CO in the cases of using the throttle body according to the present invention and using the throttle body in the prior art as shown in FIG. 11 with vehicles mounting manual transmissions during 10-mode running. The result of measurement is shown in FIG. 5. As is apparent from FIG. 5, the concentration of CO is remarkably reduced, and the variation of the concentration is also reduced in the case of using the throttle body according to the present invention.

Figure 6:
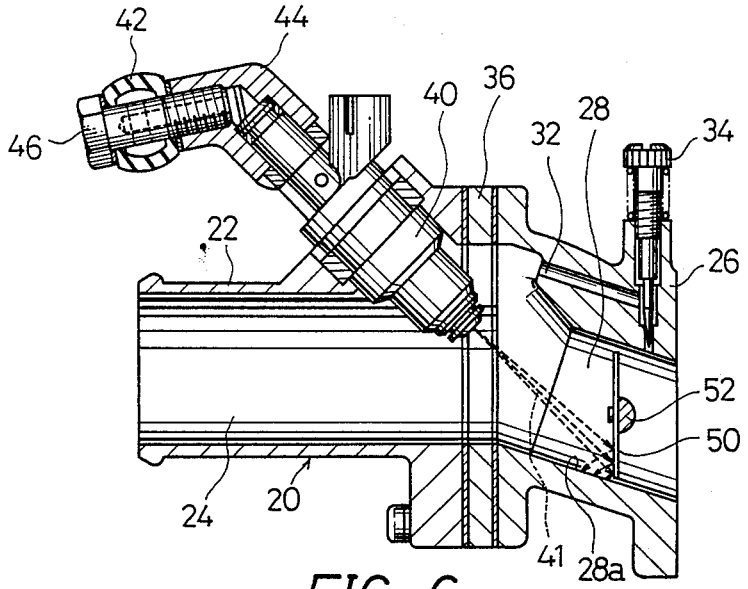
FIG. 6 is a vertical sectional view of the throttle body according to a second preferred embodiment of the present invention at a small throttle angle.
Figure 7:
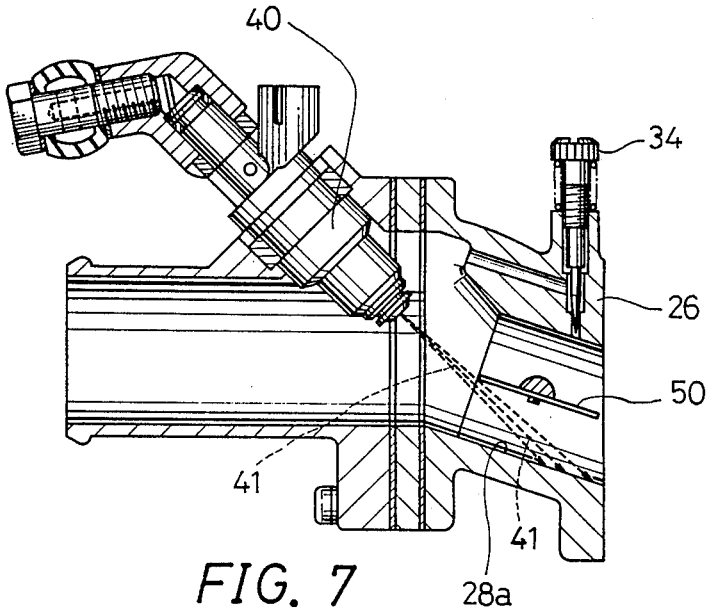
FIG. 7 is a view similar to FIG. 6 at a large throttle angle.

Referring next to FIGS. 6 and 7 which show a second preferred embodiment of the present invention, an intermediate body 36 is interposed between the upstream body 22 and the downstream body 26, so that an injected fuel 41 from the injector 40 may collide with a lower portion of a valve surface of the throttle valve 50 at idling and at a small throttle angle as shown in FIG. 6, while when the throttle angle is large, the injected fuel 41 may collide with the inner wall surface 28a of the throttle bore 28 at a position substantially under the throttle valve 50 as shown in FIG. 7. Alternatively, when the throttle angle is small, the injected fuel may collide with the inner wall surface 28a of the throttle bore 28 at a position near the throttle valve 50.

In operation, when the throttle angle of the throttle valve 50 is small as shown in FIG. 6, the injected fuel 41 from the injector 40 collides with the lower portion of the valve surface of the throttle valve 50, and is atomized with less scattering. After colliding with the valve surface, the fuel partially falls onto the inner wall surface 28a of the throttle bore 28. Thus, the atmoized fuel and the fuel deposited on the inner wall surface 28a are mixed with the suction air, and are sucked into the intake manifold 12. Accordingly, when the throttle valve 50 is in a small angle position, the injected fuel is effectively atomized by colliding with the valve surface of the throttle valve 50, thereby preventing the fuel from staying in the throttle bore 28. Therefore, it is possible to prevent that an air-fuel ratio tends to be fluctuated and improve the startability.

When the throttle angle of the throttle valve 50 is large as shown in FIG. 7, the injected fuel 41 collides directly with the inner wall surface 28a of the throttle bore 28. Accordingly, the fuel is conveyed into the intake manifold 12 by a high-speed suction air flow passing through the throttle bore 28.

Figure 8:
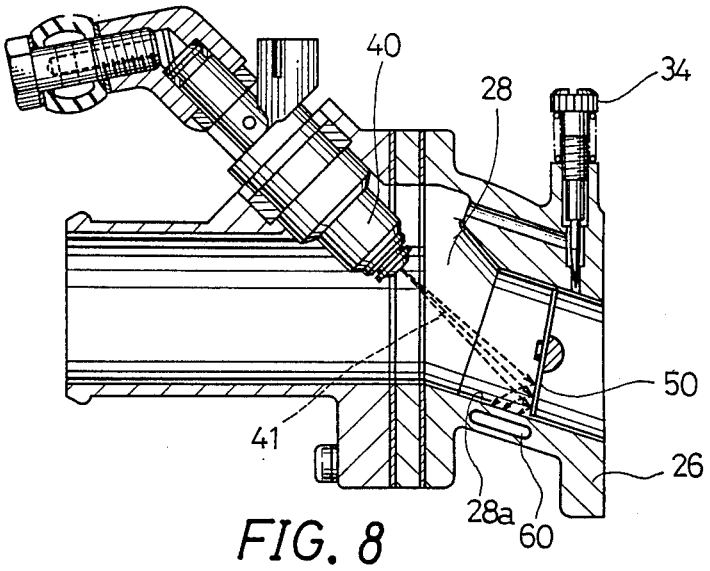
FIG. 8 is a vertical sectional view of the throttle body according to a third preferred embodiment of the present invention.

Referring to FIG. 8 which shows a third preferred embodiment of the present invention, there is provided a hot water passage 60 in a wall of the downstream body 26 at a position where the injected fuel 41 colliding with the valve surface of the throttle valve 50 falls onto the inner wall surface 28a of the throttle bore 28. With this arrangement, the fuel falling onto the inner wall surface 28a is heated by a hot water flowing in the hot water passage 60, and is allowed to more smoothly flow on the inner wall surface 28a. Accordingly, when the throttle valve 50 is changed from the small angle position to the large angle position, there is no possibility that the fuel deposited on the inner wall surface 28*a* will be momentarily supplied to the intake manifold 12, thereby preventing an air-fuel ratio from becoming overrich.

In the case that the injector 40 is so positioned as to inject the fuel toward the inner wall surface 28*a* rather than the valve surface of the throttle valve 50 at a small throttle angle, the hot water passage 60 may be provided at a position where the injected fuel directly collides with the inner wall surface 28*a*. Further, a plurality of the hot water passages 60 may be provided at any suitable positions.

Figure 9A:
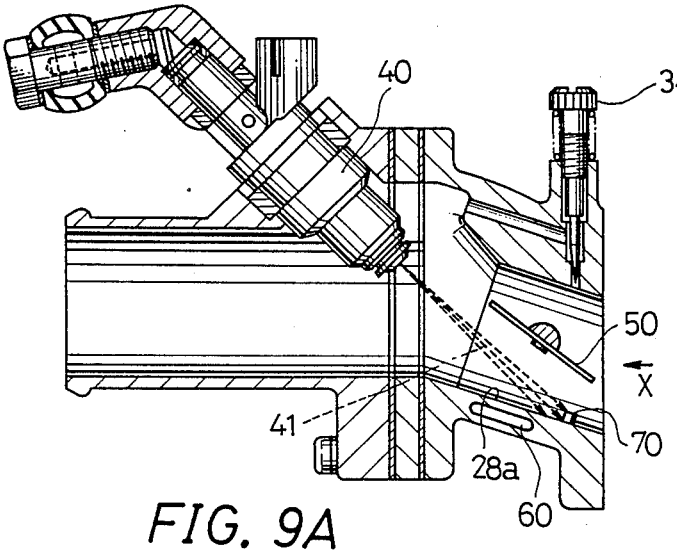
FIG. 9A is a vertical sectional view of the throttle body according to a fourth preferred embodiment of the present invention.
Figure 9B:
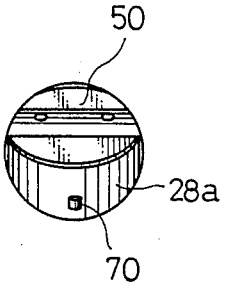
FIG. 9B is a view of an essential part of the throttle body, taken from an arrow X in FIG. 9A.

Referring to FIGS. 9A and 9B which show a fourth preferred embodiment of the present invention, there is provided a projection 70 such as a pin on the inner wall surface 28*a* of the throttle bore 28 at a position where the injected fuel 41 directly collides with the inner wall surface 28*a* at a large throttle angle. With this arrangement, the injected fuel 41 collides with the projection 70, and the atomization of the fuel is therefore accelerated. As a result, the distribution of the fuel to each of the cylinders of the engine may be improved.

Although the fourth preferred embodiment includes the hot water passage 60 mentioned in the third preferred embodiment, the hot water passage 60 may be eliminated. Further, a plurality of the projections 70 may be provided at any suitable positions.

Figure 10A:
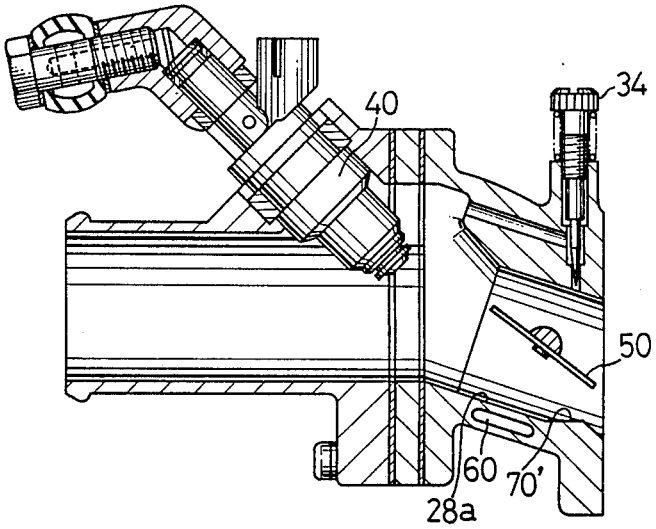
FIG. 10A is a vertical sectional view of the throttle body according to a fifth preferred embodiment of the present invention.
Figure 10B:
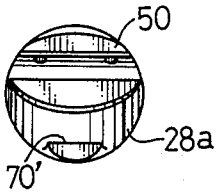
FIG. 10B is a view of an essential part of the throttle body shown in FIG. 10A, similar to FIG. 9B.

Referring to FIGS. 10A and 10B which show a fifth preferred embodiment of the present invention, a bank portion 70' instead of the projection 70 mentioned in the fourth preferred embodiment is integrally formed on the inner wall surface 28*a*. The bank portion 70' extends substantially horizontally from the inclined inner wall surface 28*a*, and sharply slopes down at a substantially intermediate position. It is appreciated that substantially the same effect as of the third preferred embodiment may be obtained.

Having thus described the preferred embodiments of the invention, it should be understood that numerous structural modifications and adaptations may be made without departing from the spirit of the invention.

What is claimed is:

1. A throttle body adapted to be mounted between an intake pipe and an intake manifold, said throttle body comprising:

an upstream body connected to said intake pipe and formed with a substantially horizontal suction passage;

a downstream body connected to said intake manifold and formed with a downwardly inclined throttle bore, said throttle bore continuously extending from said suction passage on a downstream side thereof;

a throttle valve rotatably mounted to a substantially horizontal throttle shaft in said throttle bore of said downstream body;

a projection formed on an inner wall surface of said throttle bore at a lower portion thereof at a position just downstream of said throttle valve such that rotation of said throttle valve is not hindered; and a fuel injector mounted to said upstream body in such a manner as to inject fuel toward said projection;

wherein when an opening angle of said throttle valve is small, the fuel injected from said injector collides with a lower portion of said throttle vale to be atomized, and the fuel scattered downwardly from said throttle valve onto the inner wall surface of said throttle bore is allowed to smoothly flow downstream owing to the downward inclination of said throttle bore, thereafter being sucked into an engine by an intake manifold vacuum created downstream of said throttle valve, while when the opening angle of said throttle valve is large, the fuel injected from said injector collides with said projection to be atomized, thereafter being sucked into said engine.

2. The throttle body as defined in claim 1, wherein said projection comprises a pin fixed to the inner wall surface of said throttle bore.

3. The throttle body as defined in claim 1, wherein said projection comprises a bank portion formed on the inner wall surface of said throttle bore.

4. The throttle body as defined in claim 1 further comprising a gasket interposed between said upstream body and said downstream body, wherein a lower portion of an inner periphery of said gasket is lower than a lower portion of said suction passage in said upstream body, and a lower portion of said throttle bore in said downstream body is lower than the lower portion of said inner periphery of said gasket.

5. The throttle body as defined in claim 1 further comprising a hot water passage formed in a wall of said downstream body at a position substantially under said throttle valve and just upstream of said throttle valve, whereby the fuel scattered downwardly from said throttle valve is suppressed from being deposited on the inner wall surface of said throttle bore.

* * * * *